United States Patent [19]

Croat

[11] Patent Number: 4,851,058

[45] Date of Patent: Jul. 25, 1989

[54] HIGH ENERGY PRODUCT RARE EARTH-IRON MAGNET ALLOYS

[75] Inventor: John J. Croat, Sterling Heights, Mich.

[73] Assignee: General Motors Corporation, Detroit, Mich.

[21] Appl. No.: 414,936

[22] Filed: Sep. 3, 1982

[51] Int. Cl.[4] ..... H01F 1/04

[52] U.S. Cl. ..... 148/302; 420/83; 420/121; 420/416; 420/442; 420/455; 420/581

[58] Field of Search ..... 148/31, 57, 403, 435, 148/302, 123 B; 420/455, 416, 442, 581, 583, 587, 83, 121; 75/123 E

[56] References Cited

U.S. PATENT DOCUMENTS

| | | | |
|---|---|---|---|
| 2,813,789 | 11/1957 | Glaser | 75/123 R |
| 3,615,915 | 10/1971 | Luiten et al. | 148/103 |
| 3,821,035 | 6/1974 | Martin | 148/31.57 |
| 3,997,371 | 12/1976 | Tokunga et al. | 148/31.57 |
| 4,192,696 | 3/1980 | Menth et al. | 148/101 |
| 4,308,474 | 12/1981 | Savage et al. | 310/26 |
| 4,382,061 | 5/1983 | Herget et al. | 420/435 |
| 4,402,770 | 9/1983 | Koon | 148/31.57 |
| 4,409,043 | 10/1983 | Koon | 148/403 |

FOREIGN PATENT DOCUMENTS

| | | | |
|---|---|---|---|
| 52-50598 | 4/1977 | Japan | 420/416 |
| 53-28018 | 3/1978 | Japan | 75/123 E |
| 54-76419 | 6/1979 | Japan . | |
| 55-113304 | 9/1980 | Japan . | |
| 56-29639 | 3/1981 | Japan . | |
| 56-47538 | 4/1981 | Japan | 75/123 E |
| 57-141901 | 9/1982 | Japan . | |
| WO81/00861 | 4/1981 | PCT Int'l Appl. | 148/403 |
| 420965 | 3/1974 | U.S.S.R. . | |

OTHER PUBLICATIONS

Wohlfarth, *Ferromagnetic Materials*, vol. 1, pp. 382–388, 1980.

Clark, "High-Field Magnetization and Coercivity of Amorphous Rare-Earth $Fe_2$ Alloys", Appl. Phys. Lett., vol. 23, No. 11, Dec. 1, 1973, pp. 642–644.

Terekhova et al, "Iron-Neodymium Equilibrium Diagram", Russian Metallurgy, No. 3, p. 50, 1965.

Strnat et al, "Magnetic Properties of Rare-Earth-Iron Intermetallic Compounds", IEEE Trans. on Magnetics, vol. MAG 3, No. 3, Sep. 1966, pp. 489–492.

Kabacoff et al, "Thermal and Magnet Properties of Amorphous $Pr_x(Fe_{0.8}B_{0.2})_{1-x}$", J. of App. Physics, vol. 53, No. 3, pp. 2255–2257, Mar. 1982.

Koon et al, "Magnetic Properties of Amorphous and Crystallized $(Fe_{0.82}B_{0.18})_{0.9}Tb_{0.5}La_{0.5}$", App. Phys. Lett., vol. 39, No. 10, pp. 840–842, Nov. 15, 1981.

Koon et al., "Magnetic Properties of Amorphous and Crystallized $(Fe_{0.82}B_{0.18})_{0.9}Tb_{0.05}La_{0.05}$", Appl. Phys. Lett., vol. 39, No. 10, Nov. 15, 1981, pp. 841–842.

*Primary Examiner*—John P. Sheehan

*Attorney, Agent, or Firm*—Elizabeth F. Harasek

[57] ABSTRACT

The hard magnetic properties, including intrinsic coercivity, remanence and energy product of rapidly quenched, rare earth-transition metal alloys has been substantially increased by the addition of suitable amounts of the element boron. The preferred rare earth constituent elements are neodymium and praseodymium, and the preferred transition metal element is iron.

11 Claims, 11 Drawing Sheets

HIGH ENERGY PRODUCT RARE EARTH-IRON MAGNET ALLOYS

This invention relates to a method of increasing the intrinsic magnetic coercivity of permanent magnet alloys formed by melting and rapidly cooling mixtures of rare earth and transition metal elements. More specifically, the invention relates to the addition of small amounts of boron to melted and rapidly quenched rare-earth-iron magnet alloys to increase their room temperature hard magnetic properties, including coercivity, remanent magnetization, and energy product.

BACKGROUND

U.S. Ser. No. 274,070, entitled High Coercivity Rare Earth-Iron Magnets and assigned to the assignee hereof, discloses novel hard magnet compositions and the method of making them. More specifically, it relates to alloying mixtures of one or more transition metals and one or more rare earth elements. The alloys are thereafter quenched from a molten state at a rate such that they solidify with substantially amorphous or extremely fine grained crystalline microstructures (as determinable by ordinary X-ray diffraction techniques) and have room temperature intrinsic magnetic coercivities after magnetization of at least about 1,000 Oersteds. The preferred transition metal for the magnet alloys is iron, and the preferred rare earth elements are praseodymium and neodymium. These constituents are preferred because of their relative abundance in nature, low cost, as well as inherently higher magnetic moments.

Because the usefulness of a hard magnet is a direct function of its strength, I have looked for a means of increasing the intrinsic coercivity and energy product of these and other substantially amorphous rare earth-transition metal (RE-TM) hard magnet compositions. I have also looked for a way to increase the relative iron content of amorphous rare earth-iron (RE-Fe) magnet alloys without sacrificing intrinsic coercivity. Higher iron concentration is desirable because of reduced alloy cost and improved magnetic energy product. I have also sought a way of increasing the temperature at which such magnet compositions retain their hard magnet properties.

Accordingly, it is an object of the invention to provide substantially amorphous or extremely fine grained rare earth-transition metal hard magnet compositions with improved intrinsic magnetic coercivities and energy products, even at elevated temperatures. A more particular object is to add a small amount of the element boron to known, substantially amorphous, magnetically hard rare earth-transition metal compositions to improve their intrinsic coercivities, energy products and increase their Curie temperatures.

Another object is to make hard magnet alloys by melting and rapidly quenching mixtures of one or more rare earth elements, one or more transition metal elements and boron so that the alloys exhibit high intrinsic coercivities and energy products. A more specific object is to make such high strength magnet alloys from iron, boron, and lower atomic weight rare earth elements, particularly neodymium and praseodymium. Another object is to make these magnetically hard alloys by melt spinning or a comparable process.

Yet another object of the invention is to provide a means of increasing the relative iron content of rare earth-iron alloy compositions without untoward loss of intrinsic coercivity. More particularly, it is an object to add an amount of boron to a magnetically hard, amorphous alloy of low atomic weight rare earth elements and iron sufficient to improve and stabilize its inherent intrinsic magnetic coercivity and energy product. Another particular object is to increase the residual magnetism of such high coercivity alloys by increasing their iron content.

BRIEF SUMMARY

In accordance with a preferred practice of the invention, an alloy with hard magnetic properties is formed having the basic formula $RE_{1-x}(TM_{1-y}B_y)_x$.

In this formula, RE represents one or more rare earth elements taken from the group of elements including scandium and yttrium in group IIIA of the periodic table and the elements from atomic number 57 (lanthanum) through 71 (lutetium). The preferred rare earth elements are the lower atomic weight members of the lanthanide series, particularly neodymium and praseodymium. TM herein is used to symbolize a transition metal taken from the group consisting of iron, nickel and cobalt, iron being preferred for its relatively high magnetic remanence and low cost. B represents the element boron. X is the combined atomic fraction of transition metal and boron present in a said composition and generally $0.5 \lesssim x \lesssim 0.9$. Y is the atomic fraction of boron present in the composition based on the amount of boron and transition metal present. The preferred range for y is $0.01 \lesssim y \lesssim 0.20$. The incorporation of only a small amount of boron in the compositions was found to substantially increase the coercivity of RE-Fe alloys at temperatures up to 200° C. or greater, particularly those alloys having high iron concentrations. In fact, the alloy $Nd_{0.2}(Fe_{0.95}B_{0.05})_{0.8}$ exhibited an intrinsic magnetic room temperature coercivity exceeding about 20 kiloOersteds, substantially comparable to the hard magnetic characteristics of much more expensive $SmCo_5$ magnets. The boron addition also substantially improved the energy product of the alloy and increased its Curie temperature.

The subject permanent magnet alloys were made by mixing suitable weight portions of elemental forms of the rare earths, transition metals and boron together. These mixtures were arc melted to form alloy ingots. The alloy was in turn remelted in a quartz crucible and extruded through a small nozzle onto a rotating chill surface. This produced thin ribbons of alloy. The process is generally referred to in the art as "melt spinning" and is fully described in U.S. Ser. No. 274,070. The rotational velocity of the quench wheel was adjusted so that the alloy cooled at a rate at which an alloy with a substantially amorphous to an extremely fine grained microstructure formed. The alloys claimed herein all exhibited high intrinsic magnetic coercivities. Moreover, the addition of boron in suitable amounts was found to increase the intrinsic coercivity, magnetic remanence and energy product of all melt-spun magnetically hard RE-iron alloys examined. Moreover, the Curie temperature was substantially elevated. My invention will be better understood in view of the following detailed description.

DETAILED DESCRIPTION

Figure 12:
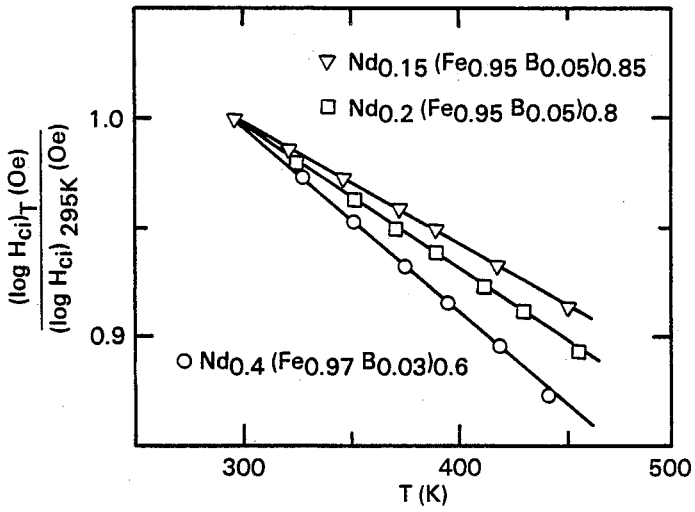

FIG. 12 plots normalized log values of intrinsic coercivity for three neodymium-iron-boron alloys as a function of temperature.

Figure 13:
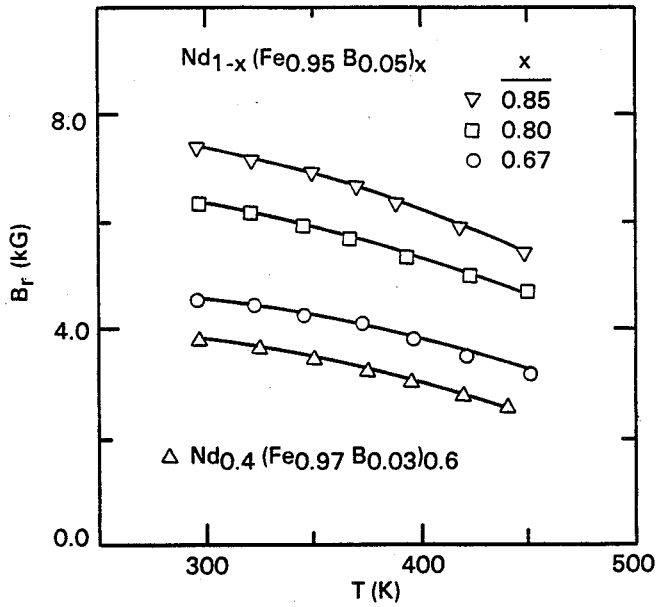

FIG. 13 is a plot showing the temperature dependence of magnetic remanence for several neodymium-iron-boron alloys.

Figure 14:
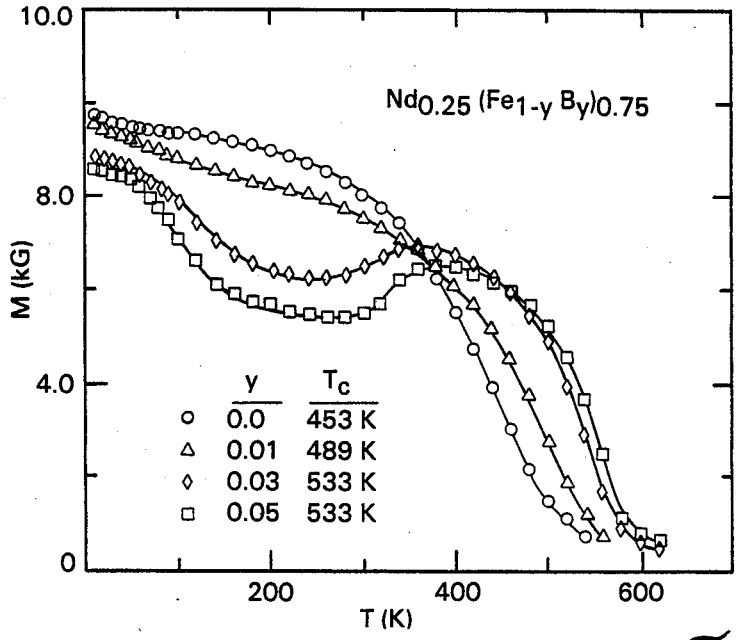

FIG. 14 plots the temperature dependence of the magnetization of melt spun $Nd_{0.25}(Fe_{1-y}B_y)_{0.75}$ at several different boron additive levels.

Figure 15:
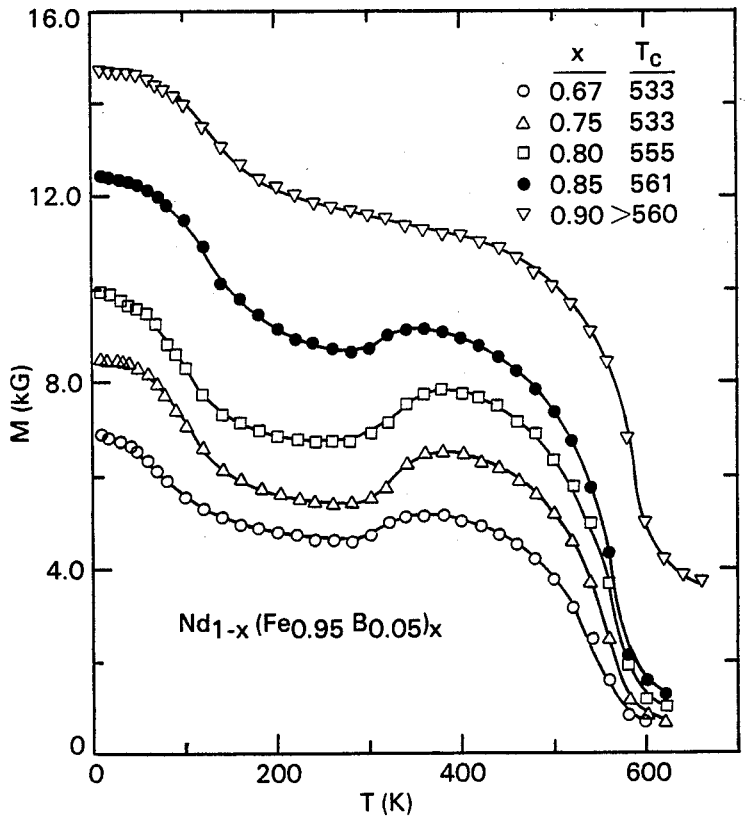

FIG. 15 is a plot of the magnetization of several melt spun $Nd_{1-x}(Fe_{0.95}B_{0.05})_x$ alloys as a function of temperature.

Figure 16:
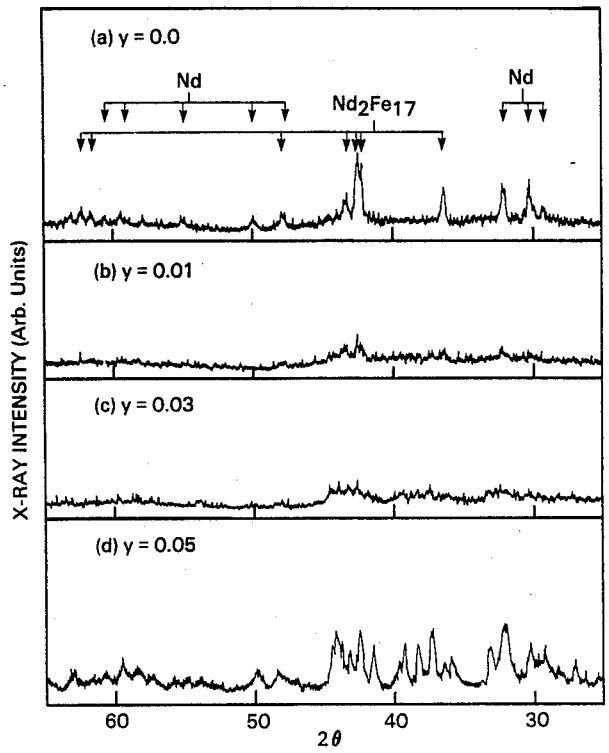

FIG. 16 shows representative x-ray spectra for melt spun $Nd_{0.25}(Fe_{1-y}B_y)_{0.75}$ alloys for values of $2\theta$ between about 75 and 15 degrees.

Figure 17:
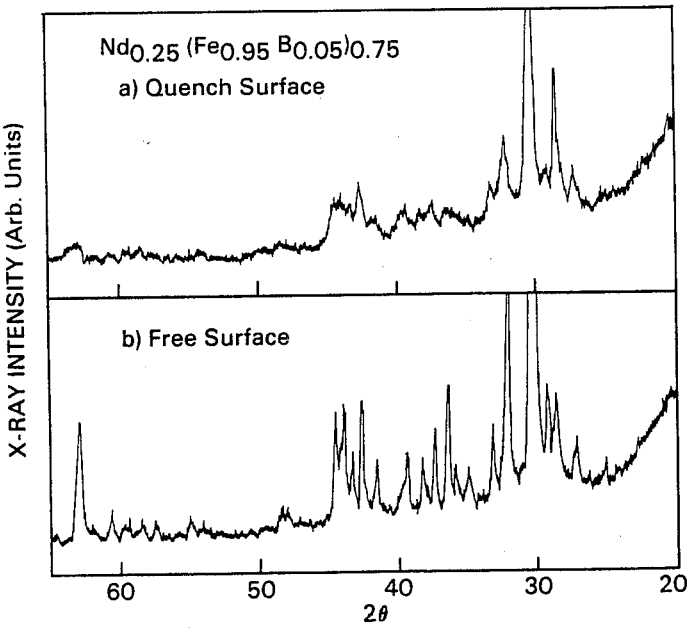

FIG. 17 shows X-ray spectra of melt spun $Nd_{0.25}(Fe_{0.95}B_{0.05})_{0.75}$ taken for material located on the quench surface of a ribbon of the alloy and for a sample of material remote from the quench surface (free surface).

Figure 18:
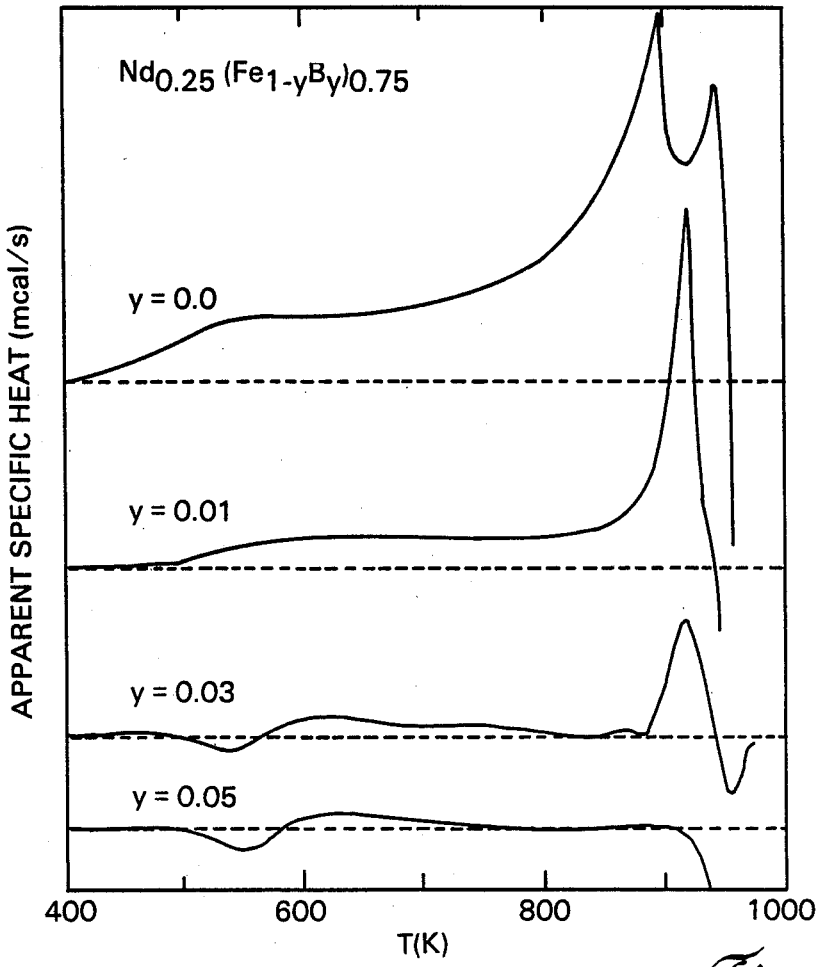

FIG. 18 shows differential scanning calorimetry tracings for $Nd_{0.25}(Fe_{1-y}B_y)_{0.75}$ alloys taken at a heating rate of 80° K. per minute.

Figure 19:
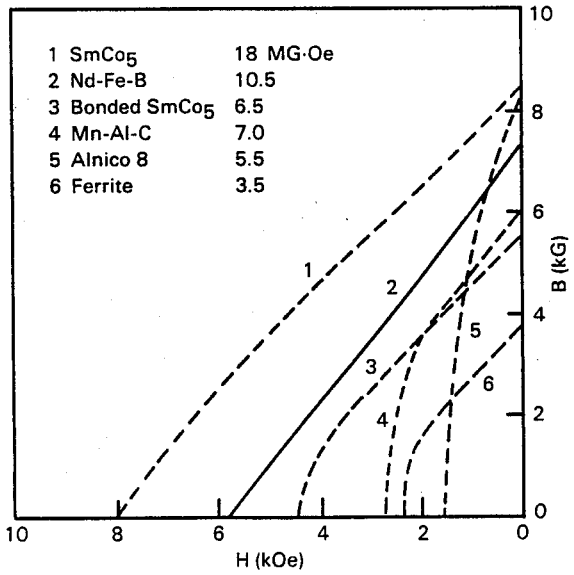

FIG. 19 shows typical demagnetization curves for several permanent magnet materials and values of maximum magnetic energy products therefor.

Figure 20:
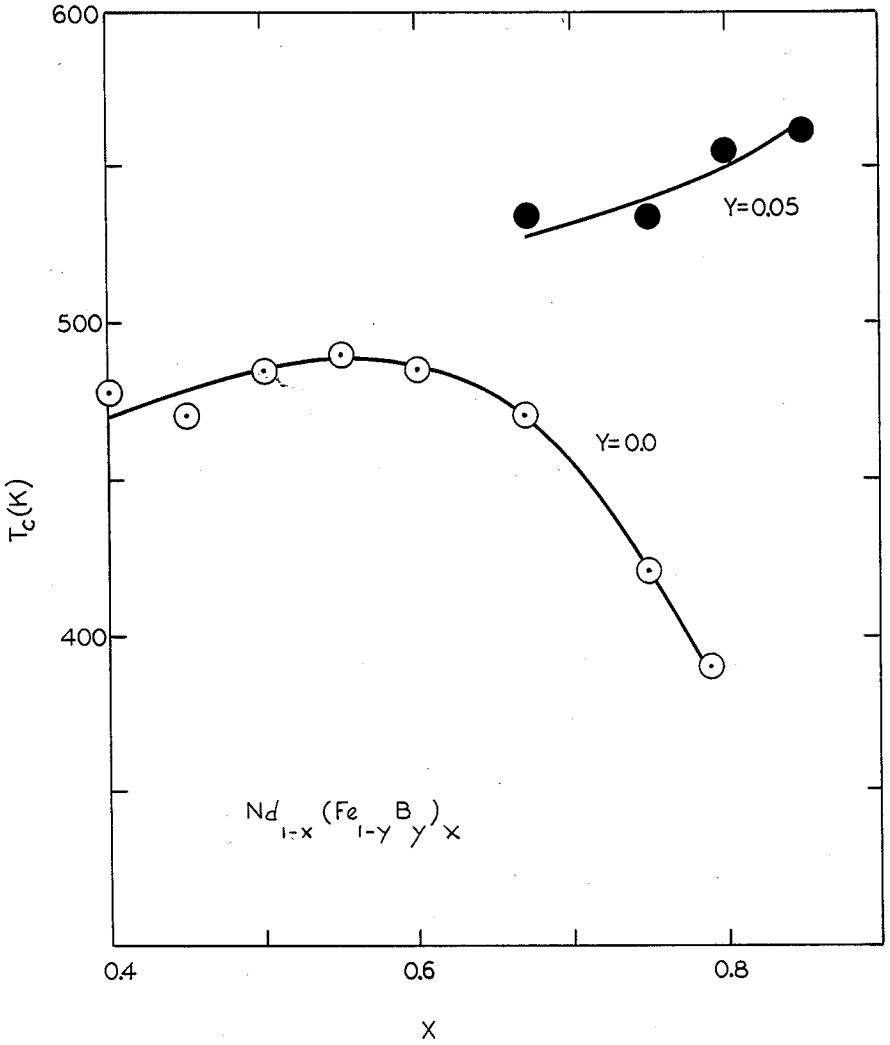

FIG. 20 shows the effect of adding boron to $Nd_{1-x}(Fe_{1-y}B_y)_x$ alloys on Curie temperature.

Figure 21:
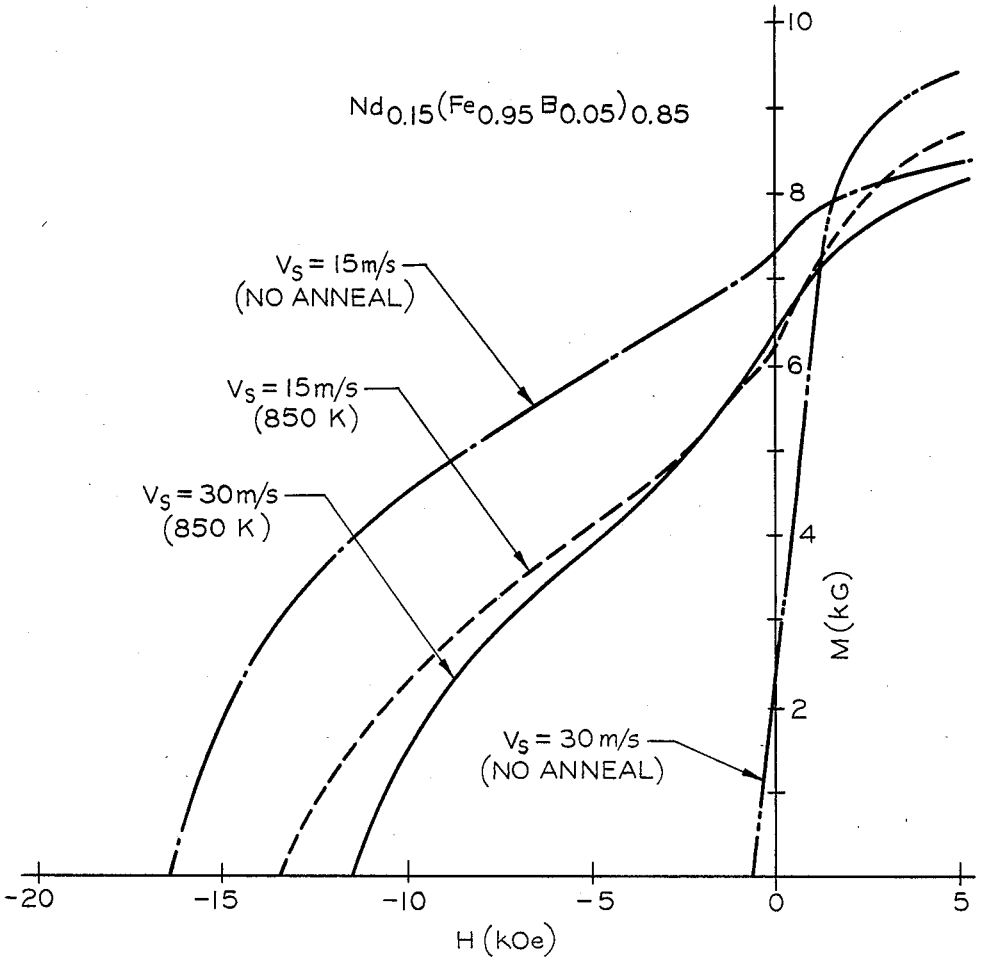

FIG. 21 is a plot showing the relative coercivities of $Nd_{0.15}(Fe_{0.95}B_{0.05})_{0.85}$ samples melt spun at quench wheel speeds of 30 and 15 meters per second thereafter annealed at about 850° K.

This invention relates to making improved magnetically hard rare earth-transition metal compositions by adding small amounts of the element boron and quenching molten mixtures of the constituents at a rate between that which yields an amorphous magnetically soft material and that yielding magnetically soft crystalline material.

Herein, H refers to strength of an applied magnetic field; $H_{ci}$ is the intrinsic coercive force or reverse field required to bring a magnetized sample having magnetization M back to zero magnetization; M is the magnetization of a sample in electromagnetic units; $M_s$ is the saturation magnetization or the maximum magnetization that can be induced in a sample by an applied magnetic field; B is the magnetic induction or magnetic flux density of a sample where $B=H+4\pi M$ (emu), where B, M and H are in units of Gauss or Oersteds; $B_r$ is the remanent magnetic induction; BH is the energy product; and T is temperature in degrees Kelvin unless otherwise indicated. The terms "hard magnet" and "magnetically hard alloy" herein refer to compositions having intrinsic coercivities of at least about 1,000 Oersteds.

Melt Spinning

The process of melt spinning RE-TM alloys to produce magnetically hard, substantially amorphous compositions is described in detail in U.S. Ser. No. 274,070. Melt spinning is a well known process and as it relates to this invention entails mixing suitable weight portions of the constituent elements and melting them together to form an alloy of a desired composition. Arc melting is a preferred technique for experimental purposes because it prevents any contamination of the alloys from the heating vessel. The alloyed material is then broken into chunks small enough to fit inside a spin melting tube or crucible made of quartz, ceramic, or other suitable material. The tube has a small orifice in its bottom through which an alloy can be ejected. The top of the tube is sealed and provided with means for containing pressurized gas in the tube above a molten alloy. A heating coil is disposed around the portion of the tube containing the alloy to be melt spun. When the coil is activated, the chunks of alloy within the tube melt and form a fluid mass. An inert gas is introduced into the space above the molten alloy at a constant positive pressure to eject it through the small orifice at a constant rate. The orifice is located only a short distance from a chill surface on which the molten metal is rapidly cooled and solidified into ribbon form. The surface is the outer perimeter of a rotating copper disc plated with chromium although any other chill material having high thermal conductivity would also be acceptable. The disc is rotated at a constant speed so that the relative velocity between the ejected alloy and the chill surface is substantially constant. Herein, the disc speed ($V_s$) is the speed in meters per second of a point on the chill surface of the disc as it rotates at a constant rotational velocity. Because the chill disc is much more massive than the alloy ribbon, it acts as an infinitely thick heat sink for the metal that solidifies on it. The disc may be cooled by any suitable means to prevent heat build-up during long runs. The terms "melt-spinning" or "melt-spun" as used herein refer to the process described above as well as any like process which achieves a like result.

The principal limiting factor for the rate of chill of a ribbon of alloy on the disc surface is its thickness. If the ribbon is too thick, the metal most remote from the chill surface will cool too slowly and crystallize in a magnetically soft state. However, if the alloy cools too quickly, the ribbon will be amorphous and have low intrinsic magnetic coercivity, generally less than a few hundred Oersteds. Thus $V_s$ and the rate at which a molten alloy is expressed are critical to the creativity of the subject magnet alloys having magnetic coercivities of several thousand Oersteds and magnetic energy products on the order of $10^6$ Gauss.Oersted.

In all of the following examples, a melt spinning apparatus of the type described above was used to make ribbons of the novel magnetic compositions. The tube was about 4 in. long and ½ in. in diameter. About 2 grams of alloy chunks were added to the tube for each run and the induction heater was activated. The alloys were heated until melted. Thereafter, an ejection pressure of about 5 psi was generated in the tube with argon gas. The ejection orifice was round and 500 microns in diameter. The orifice was located about ⅛ to ¼ inches from the chill surface of the cooling disc. The disc was initially at room temperature and was not externally cooled. The resultant melt spun ribbons were about 30–50 microns thick and about 1.5 millimeters wide.

While melt spinning is a preferred method of making the subject boron enhanced RE-TM magnet materials, other comparable methods may be employed. The critical element of the melt spinning process is the controlled quenching of the molten alloy to produce a substantially amorphous to extremely finely crystalline microstructure. The terms "substantially amorphous" and "finely crystalline" herein refer to solids having x-ray diffraction patterns which do not indicate the presence of fully crystalline phases. X-ray patterns of the subject RE-TM-B alloys have ranged from substantially flat to those exhibiting definite peaks of low intensity which would not be indicative of the presence of a uniform, totally crystalline alloy. Any other process accomplishing a like controlled cooling of the alloys from their melts could be used.

Compositions

The hard magnet compositions of this invention are formed from molten homogenous mixtures of certain rare earth elements, transition metal elements and boron.

Rare earth elements suitable for use in the invention are scandium and yttrium in group IIIA of the periodic table and also include certain of the lanthanide series elements from atomic No. 57 (lanthanum) through atomic No. 71 (lutetium). The preferred rare earth elements are the lower atomic weight members of the lanthanide series, particularly, neodymium and praseodymium. These are among the most abundant and least expensive of the rare earths. Other suitable elements include samarium, terbium, dysprosium, holmium, erbium and thulium. Also suitable are mischmetals of the above named rare earth elements, which consist predominantly of the lower atomic weight elements. Other rare earth elements may form suitable inherently magnetic species when alloyed with these preferred elements. In order to achieve the desired high magnetic coercivities for the subject magnet compositions, I believe that the f-orbital of the preferred rare earth constituent elements or alloys should not be empty, full or half full. That is, there should not be zero, seven or fourteen electrons in the f-orbital.

The transition metals, with magnetic properties appropriate for use in the practice of the invention, include the elements iron, nickel and cobalt. However, iron is highly preferred because of its relative abundance and low cost. It also exhibits higher magnetic remanence than nickel.

Boron was used in elemental form in all cases as were the rare earth and transition elements. However, alloyed forms of the elements would be equally suited. Small amounts of other elements may be present so long as they do not significantly deteriorate the magnetic properties of the compositions.

The relative amounts of RE, TM and B alloyed together are expressed herein in terms of atomic weight fractions or percents. For example, on a constituent formula basis, one atomic weight unit of the composition $Nd_{0.4}(Fe_{0.95}B_{0.05})_{0.6}$ would comprise by weight:

| | |
|---|---|
| 0.4 × atomic wt. Nd = 0.4 × 144.24 = | 57.696 g Nd |
| 0.6 × 0.95 × atomic wt. Fe = 0.57 × 55.85 = | 31.835 g Fe |
| 0.6 × 0.05 × atomic wt. B = 0.03 × 10.81 = | 0.324 g B |
| | 89.855 g total |

which expressed as atomic weight fractions or atomic weight percents of the constituents is:

| | atomic wt. fraction | atomic wt. percent |
|---|---|---|
| Nd | 57.696/89.855 = 0.642 | 64.2 |
| Fe | 31.835/89.855 = 0.354 | 35.4 |
| B | 0.324/89.855 = 0.004 | 0.4 |

The preferred compositional range for the subject hard magnet alloys of this invention is about 10 to 50 atomic percent rare earth elements with the balance being transition metal elements and a small amount (less than about 10 and preferably less than about 6 atomic percent total) boron. Higher percentages of the rare earth elements are possible but may adversely effect the magnetic energy product. Small amounts of other elements may be present so long as they do not materially adversely effect the practice of the invention. My invention will be better understood in view of the following examples.

EXAMPLE 1

Figure 1:
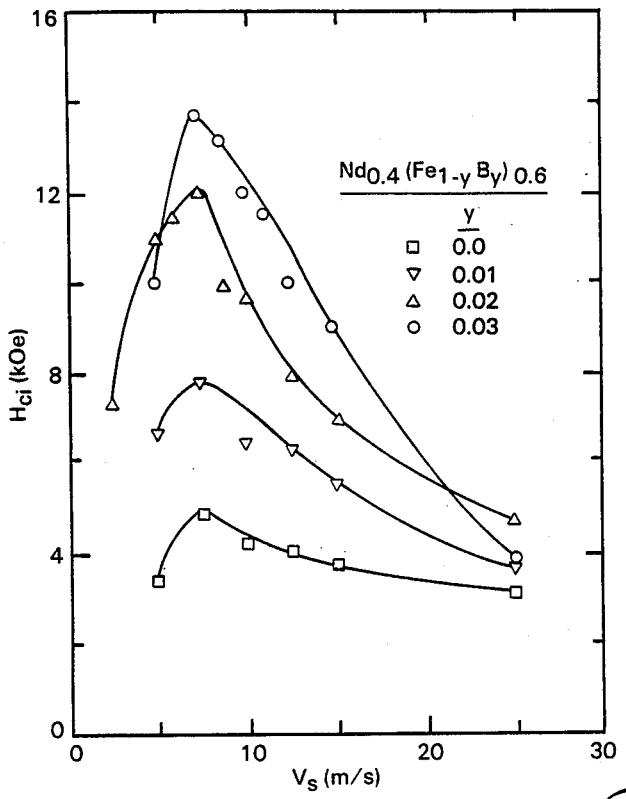
FIG. 1 is a plot of room temperature intrinsic coercivity for magnetized melt spun $Nd_{0.4}(Fe_{1-y}B_y)_{0.6}$ alloys as a function of the linear speed ($V_s$) of the quench surface.

Referring to FIG. 1, alloys of neodymium and iron were made by mixing substantially pure commercially available forms of the elements in suitable weight proportions. The mixtures were arc melted to form alloy ingots. The amount of neodymium was maintained in each alloy at an atomic fraction of 0.4. The iron and boron constituents together made up an atomic fraction of 0.6. The atomic fraction of boron, based on the amount of iron present was varied from 0.01 to 0.03. Each of the alloys was melt spun by the method described above. The quench rate for each alloy was changed by varying the surface velocity of the quench wheel. About two grams of ribbon were made for each sample.

The intrinsic coercivity of each of the alloys for this and the other Examples was determined as follows. The alloy ribbon was first pulverized to powder with a roller on a hard surface. Approximately 100 mg of powder was compacted in a standard cylindrical sample holder. The sample was then magnetized in a pulsed magnetic field of approximately 45 kiloOersteds. This field is not believed to be strong enough to reach magnetic saturation ($M_s$) of the subject alloys but was the strongest available for my work. The intrinsic coercivity measurements were made on a vibrating sample magnetometer with a maximum operating field of 19 kOe. Magnetization values were normalized to the density of the arc melted magnet material.

It can be seen from FIG. 1 that the intrinsic coercivity ($H_{ci}$) is dependent both on quench rate (a function of $V_s$) and boron content. The highest overall intrinsic coercivities were achieved for the neodymium iron alloy containing three percent boron based on iron. Lesser percentages of boron improved the intrinsic coercivity of the composition over boron free alloy. The optimum substrate velocity appeared to be about 7.5 meters per second. Intrinsic coercivities were lower for wheel speeds below 5 meters per second and above 15 meters per second.

EXAMPLE 2

Figure 2:
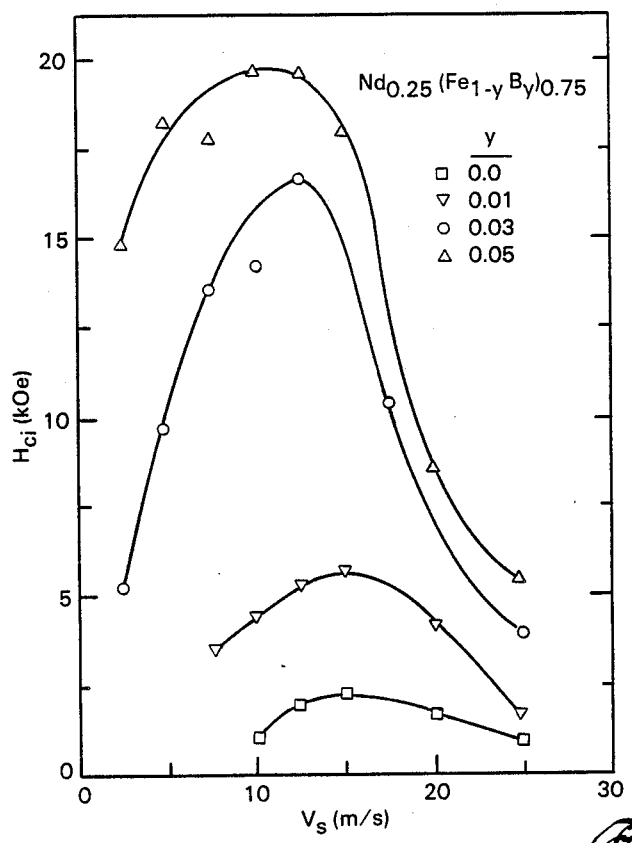
FIG. 2 is a plot of room temperature intrinsic coercivity for magnetized melt spun $Nd_{0.25}(Fe_{1-y}B_y)_{0.75}$ alloys versus the linear speed of the quench surface.

FIG. 2 is a plot of intrinsic magnetic coercivity versus substrate quench speed for alloys of neodymium and iron where neodymium comprises 25 atomic percent of the alloy. The samples were made and tested as in Example 1. Clearly, the inclusion of boron in amounts of three and five atomic percent based on iron content greatly improved the intrinsic room temperature coercivity for these alloys. Without boron, this high iron content alloy does not show very high intrinsic coercivity (~2.3 kOe maximum). It appears that the inclusion of even a small amount of boron can create high intrinsic magnetic coercivity in certain alloys where it would otherwise not be present. The $Nd_{0.25}(Fe_{0.95}B_{0.05})_{0.75}$ alloy (3.75 atomic percent B) achieved an $H_{ci}$ of 19.7 kOe, comparable, e.g., to the intrinsic coercivities of rare earth-cobalt magnets.

EXAMPLE 3

Figure 3:
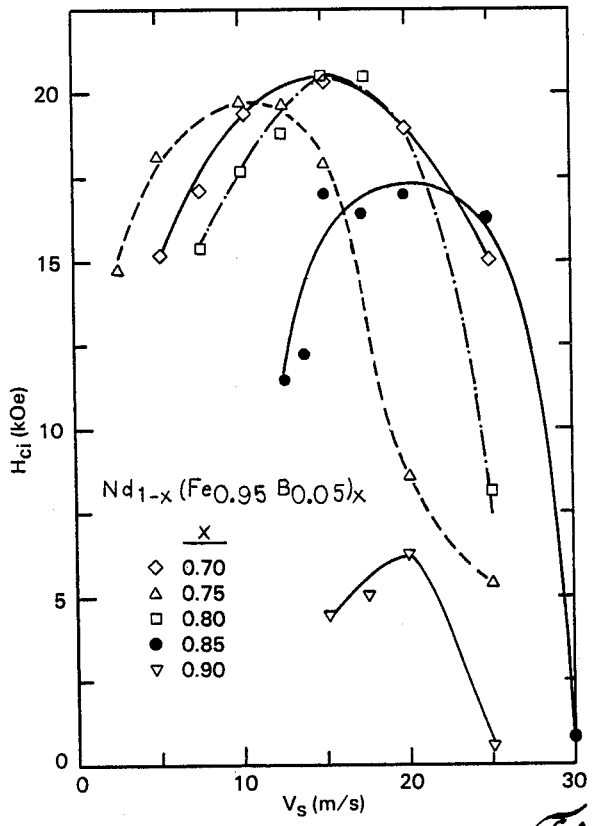
FIG. 3 is a plot of room temperature intrinsic coercivity for magnetized melt spun $Nd_{1-x}(Fe_{0.95}B_{0.05})_x$ alloys versus the linear speed of the quench surface.

FIG. 3 is a plot of intrinsic room temperature coercivity as a function of quench velocity for melt spun alloy ribbons of neodymium, iron and boron where the Nd content was varied from 10 to 33 atomic percent and the ratio of iron to boron is held constant at 0.95 to 0.05. The maximum coercivity achieved for the ten atomic weight percent neodymium alloy was only about 6 kiloOersteds. For 15 atomic percent neodymium the initial intrinsic coercivity was about 7 kiloOersteds. For all other neodymium contents, however, the initial intrinsic coercivity was at least about 15 kiloOersteds. The optimum quench velocity for these alloys appeared to be in the 10 to 15 meter per second range.

EXAMPLE 4

Figure 4:
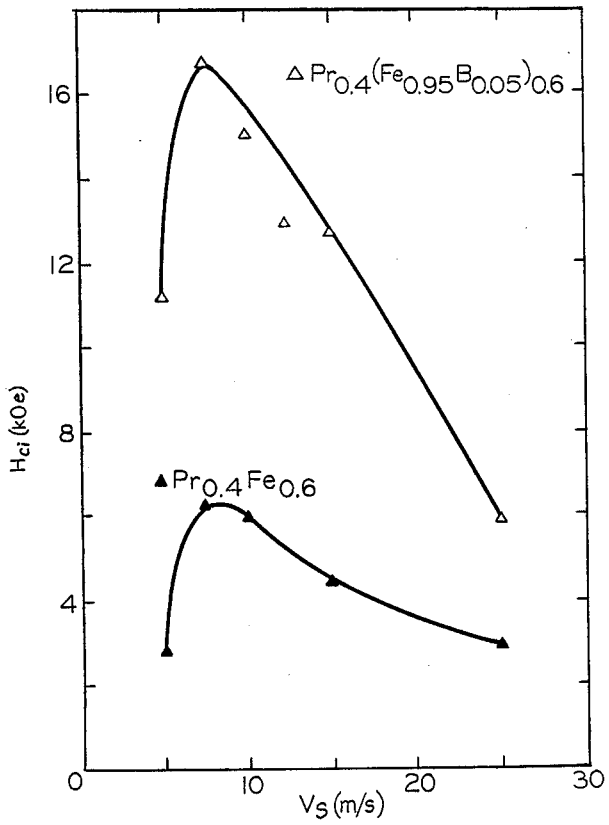
FIG. 4 is a plot of room temperature intrinsic coercivity for magnetized $Pr_{0.4}Fe_{0.6}$ and $Pr_{0.4}(Fe_{0.95}B_{0.05})_{0.6}$ alloys as a function of the linear speed of the quench surface.

FIG. 4 shows the intrinsic room temperature coercivity for $Pr_{0.4}Fe_{0.6}$ and $Pr_{0.4}(Fe_{0.95}B_{0.05})_{0.6}$. The addition of a small amount of boron, here 5 percent based on the atomic percent iron was found to improve the intrinsic coercivity of praseodymium-iron compounds from roughly 6.0 to over 16 kOe at quench velocities of about 7.5 meters per second. While I have extensively examined neodymium-iron systems, I believe that the other rare earth and transition metal alloys processed in accordance with the subject invention will exhibit improved intrinsic coercivities by the addition of small amounts of boron.

EXAMPLE 5

Figure 5:
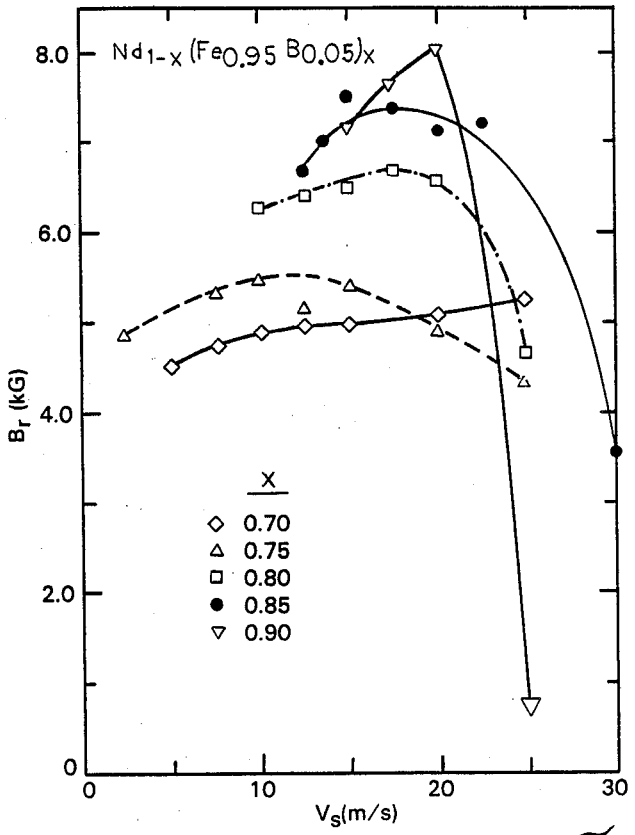
FIG. 5 is a plot of remanent magnetization of melt spun $Nd_{1-x}(Fe_{0.95}B_{0.05})_x$ alloys at room temperature versus the linear speed of the quench surface.

FIG. 5 is a plot of remanent magnetization ($B_r$) measured at room temperature for melt spun neodymium iron alloys as a function of substrate quench speed. For the high iron content alloys there is clearly a critical substrate quench velocity beyond which the magnetic remanence of the material falls off rapidly. At substrate quench speeds less than 20 meters per second, all of the neodymium alloys showed remanent magnetization values of at least about four kiloGauss. Increasing the Fe concentration results in an appreciable increase in remanent magnetization from a maximum of 4.6 kG at X=0.67 to 8.0 kG for X=0.9.

EXAMPLE 6

Figure 6:
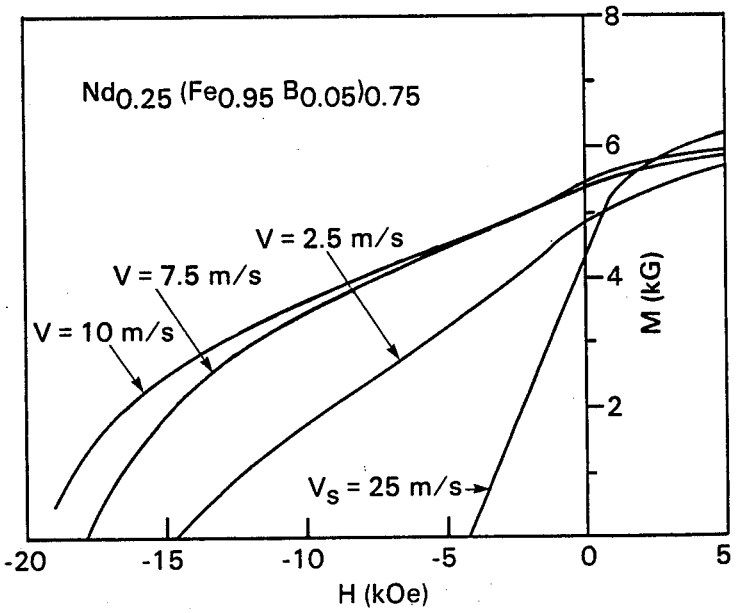
FIG. 6 shows demagnetization curves for melt spun $Nd_{0.25}(Fe_{0.95}B_{0.05})_{0.75}$ as a function of the linear speed of the chill surface.

FIG. 6 is a demagnetization curve for melt spun $Nd_{0.25}(Fe_{0.95}B_{0.05})_{0.75}$ for several different substrate chill velocities. The relatively square hysteresis loop characterized by the relatively flat demagnetization curves in the second quadrant for $V_s=7.5$ and $V_s=10$ meters per second is desirable for many hard magnet applications, and is indicative of a high energy product magnet.

EXAMPLE 7

Figure 7:
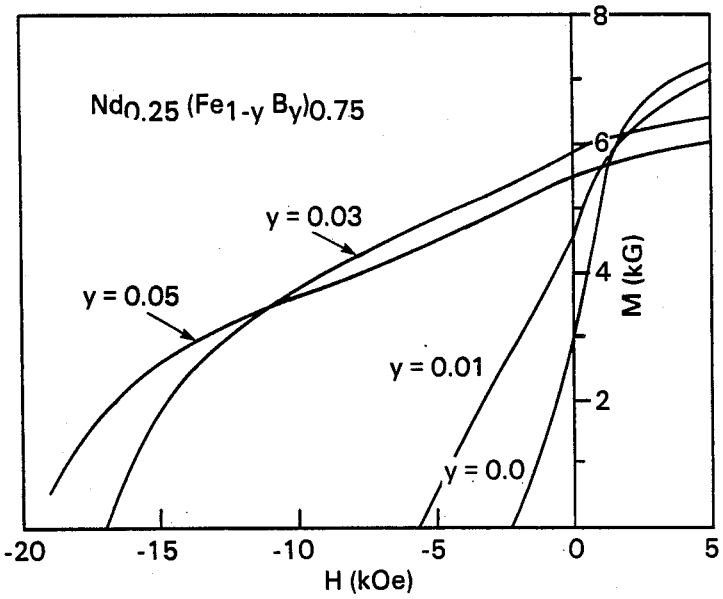
FIG. 7 shows demagnetization curves for melt spun $Nd_{0.25}(Fe_{1-y}B_y)_{0.75}$ alloys.

FIG. 7 shows demagnetization curves for melt spun 25 atomic percent neodymium iron alloys. The addition of 0.03 and 0.05 atomic fractions boron (based on iron content) served to substantially flatten and extend the demagnetization curves for this alloy indicating higher energy products. Higher boron levels than those shown in FIG. 7, e.g. Y=0.07, result in small additional increases in coercivity but remanent magnetization drops, resulting in lowered energy product. Generally, not much benefit in intrinsic coercivity is gained and a loss of energy product may occur by adding more than 10 atomic percent boron to a melt spun rare earth-iron alloy.

EXAMPLE 8

Figure 8:
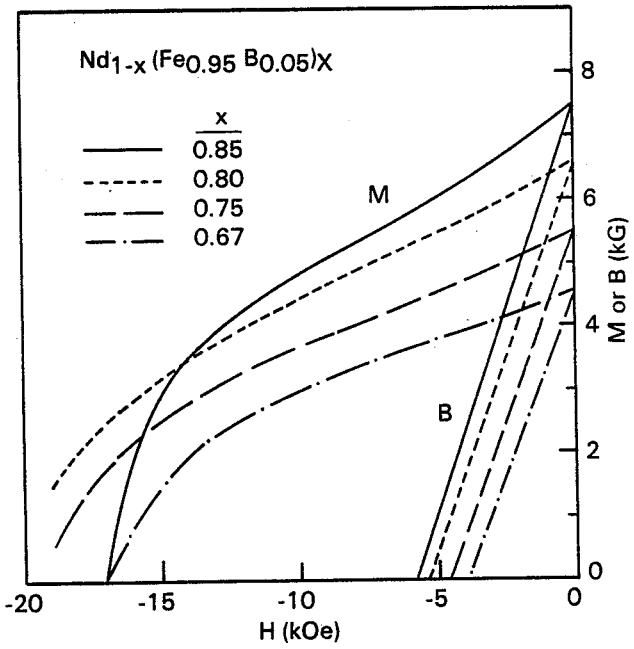
FIG. 8 is a demagnetization curve for melt spun $Nd_{1-x}(Fe_{0.95}B_{0.05})_x$ alloys.

FIG. 8 shows demagnetization curves for $Nd_{1-x}(Fe_{0.95}B_{0.05})_x$ alloys expressed in terms of magnetization (M) and magnetic induction (B) versus applied field (H). The enegy product increases appreciably with increased Fe content. The energy product for the X=0.85, B=0.05 alloy is the highest I have obtained to date and is approximately 10.5 MG.Oe.

EXAMPLE 9

Figure 9:
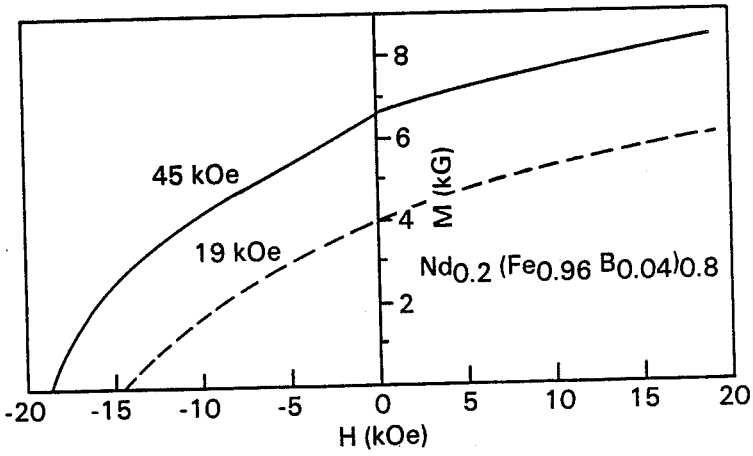
FIG. 9 shows demagnetization curves for melt spun $Nd_{0.2}(Fe_{0.96}B_{0.04})_{0.8}$ alloy for initial magnetizing fields of 19 kOe and 45 kOe.

FIG. 9 shows demagnetization curves for melt spun $Nd_{0.2}(Fe_{0.96}B_{0.04})_{0.8}$ alloy as a function of the initial magnetizing field. The curve is substantially lower for the 19 kiloOersted magnetizing field than the 45 kiloOersted field. As noted in Example 1, I believe that slightly higher remanent magnetization and $H_{ci}$ could be achieved for the subject Re-Fe-B compositions given a stronger magnetizing field.

EXAMPLE 10

Figure 10:
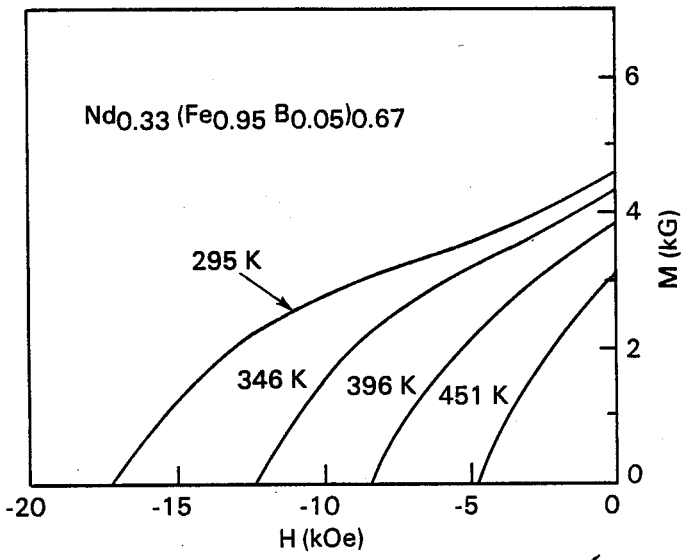
FIG. 10 shows demagnetization curves for melt spun $Nd_{0.33}(Fe_{0.95}B_{0.05})_{0.67}$ at several different temperatures between 295° K. and 450° K.

FIG. 10 shows demagnetization curves for melt spun $Nd_{0.33}(Fe_{0.95}B_{0.05})_{0.67}$ as a function of temperature. The samples were remagnetized in the pulsed 45 kOe field between temperature changes. Elevated temperatures have some adverse effect on the remanent magnetization of these materials. Experimental evidence indicates that approximately 40 percent of the $H_{ci}$ may be lost between temperatures of 400° and 500° K. This is generally comparable to the losses experienced by mischmetal-samarium-cobalt, and $SmCo_5$ magnets at like temperatures. Given the high initial $H_{ci}$ of my alloys, however, in many applications such losses may be tolerated.

EXAMPLE 11

Figure 11:
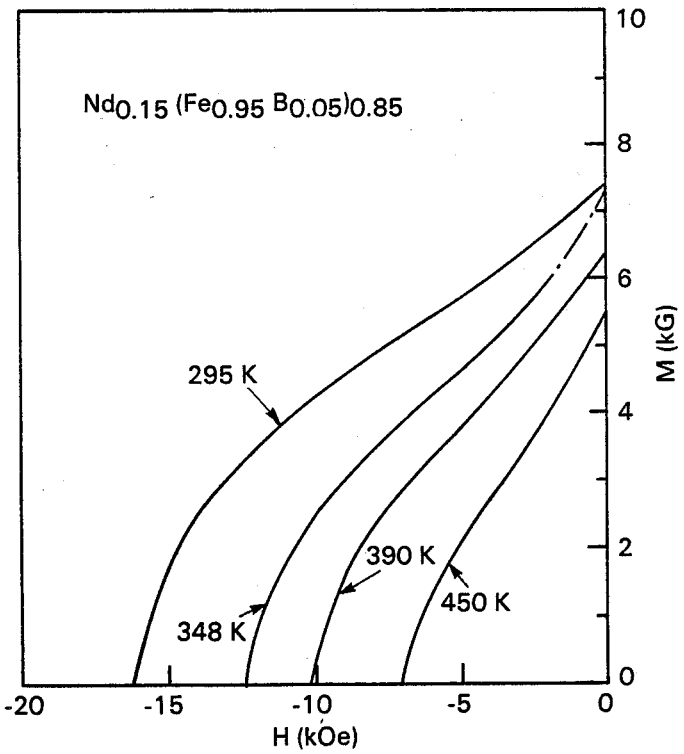
FIG. 11 shows demagnetization curves of melt spun $Nd_{0.15}(Fe_{0.95}B_{0.05})_{0.85}$ at several different temperatures between 295° K. and 450° K.

FIG. 11 shows demagnetization curves for melt spun $Nd_{0.15}(Fe_{0.95}B_{0.05})_{0.85}$ as a function of temperature. When compared to FIG. 10, it is clear that higher atomic percentages of iron tend to improve the magnetic remanence and hence, energy product of the subject alloys at elevated temperatures.

EXAMPLE 12

FIG. 12 shows a normalized plot of the log of intrinsic coercivity as a function of temperature for three different neodymium-iron-boron alloys. In the higher iron content alloy intrinsic coercivity decreases less rapidly as a function of temperature than in the higher neodymium fraction containing compounds.

EXAMPLE 13

FIG. 13 shows the value of magnetic remanence as a function of temperature in degrees Kelvin for $Nd_{1-x}(Fe_{0.95}B_{0.05})_x$ alloys where X=0.85, 0.80, 0.67 and for $Nd_{0.4}(Fe_{0.97}B_{0.03})_{0.6}$. Again, the higher iron content alloys show higher remanence at elevated temperatures.

EXAMPLE 14

FIG. 14 shows magnetization dependence of melt spun $Nd_{0.25}(Fe_{0-y}B_y)_{0.75}$ on temperature. The higher boron content alloys showed a dip in the magnetization curve at temperatures between about 100° and 300° Kelvin. The reason for this apparent anomoly is not currently understood. The Curie temperature ($T_c$) was substantially elevated by the addition of boron: $T_c$=453° K. for no boron and 533° K. with 3.75 atomic percent boron (Y=0.05). FIG. 20 shows the effect of adding boron on Curie temperature for several neodymium-iron-boron alloys.

EXAMPLE 15

FIG. 15 shows the effect of varying the amount of neodymium in a neodymium-iron-boron alloy on magnetization of melt spun samples at temperatures between 0° and 600° K. The dip between 100° and 300° Kelvin is noted in all of the curves although the high iron content alloy magnetization curve is substantially flatter in that temperature range than the higher neodymium content alloys.

EXAMPLE 16

FIG. 16 shows x-ray spectra (CuKα) of $Nd_{0.25}(Fe_{1-y}B_y)_{0.75}$, Y=0.00, 0.01, 0.03, 0.05, alloy samples that exhibited maximum intrinsic coercivity for each boron level. The data were taken from finely powdered specimens. The x-ray intensity units are on an arbitrary scale.

The boron-free alloys contain Bragg reflections corresponding to the neodymium and $Nd_2Fe_{17}$ phases, neither of which is believed to account for even a limited amount of coercivity in these alloys since the highest Curie temperature of either ($Nd_2Fe_{17}$) is only 331° K. It appears that the addition of boron may result in increasingly glass-like alloy behavior up to additions of about 3.75 atomic percent [$Nd_{0.25}(Fe_{0.95}B_{0.05})_{0.75}$] at which point the x-ray data indicate a multiphase finely crystalline structure develops which seems to include some neodymium metal and at least one other unidentified phase.

EXAMPLE 17

FIG. 17 compares the X-ray spectra of the quenched surface of an $Nd_{0.25}(Fe_{0.95}B_{0.05})_{0.75}$ alloy ribbon to the free surface. The quench surface is defined as that surface of the ribbon which impinges on the cooling substrate. The free surface is the opposite flat side of the ribbon which does not contact the cooling substrate. Clearly, the free surface sample shows more crystallinity than the quenched surface. This may be explained by the fact that the free surface cools relatively slower than the quenched surface allowing more time for crystallographic ordering of the elements.

EXAMPLE 18

FIG. 18 displays differential scanning calorimetry data for the four alloys depicted in FIG. 16. The data were taken at a heating rate of 80° K. per minute. The addition of boron appeared to reduce the amorphous or glass-like characteristics of the melt spun alloy. This was not expected as boron is known to promote glass-formation in some other compositions, e.g., ($Fe_8B_2$). The Y=0.05 alloys appear to have a particularly crystalline nature as indicated by the absence of any exothermic heat release up to 1000° K. The sharp exotherm at ~940° K. is believed to be associated with partial melting of the alloy.

EXAMPLE 19

FIG. 19 shows typical demagnetization curves for various permanent magnet materials and lists values for their maximum energy products. Clearly, only $SmCo_5$ shows better room temperature magnetic properties than the subject neodymium-iron-boron compositions. Bonded $SmCo_5$ powder magnets are substantially weaker. Thus, it is believed that the subject RE-TM-B compositions could be used in high quality, high coercivity, hard magnet applications at substantially less cost than $SmCo_5$. Moreover my hard magnet compositions have much better properties than conventional manganese-aluminum-carbon, Alnico, and ferrite magnets.

EXAMPLE 20

FIG. 20 shows that adding boron to $Nd_{1-x}(Fe_{1-y}B_y)_x$ alloys substantially elevates the alloys' Curie temperatures. So far as practical application of the subject invention is concerned, increased Curie temperature greatly expands the possible uses for these improved hard magnet materials. For example, magnets with Curie temperatures above about 500° K. (237° C.) could be used in automotive underhood applications where temperatures of 200° C. are commonly encountered.

The data points which are blacked in FIG. 20 particularly show the substantial increase in Curie temperature provided by adding 5 percent boron based on the iron content of neodymium-iron melt spun alloys having less than 40 atomic percent neodymium. Like alloys without boron added to them showed a marked tendency to lowered Curie temperature in alloys containing less than 40 atomic percent neodymium. Thus, adding boron to suitable substantially amorphous RE-TM alloys not only increases intrinsic magnetic coercivity but also increases Curie temperature. Both results are very desirable.

EXAMPLE 21

Experiments were conducted on iron rich alloys to determine whether comparable hard magnet characteristics could be induced in the subject RE-TM-B compositions by annealing magnetically soft amorphous forms of the alloy. Referring to FIG. 21, a representative alloy of $Nd_{0.15}(Fe_{0.95}B_{0.05})_{0.85}$ was melt spun onto a chill disc having a surface velocity $V_s$ of 30 meters per second. The ribbon so produced was amorphous and had soft magnet characteristics indicated by the sharp slope of its demagnetization curve (solid line in FIG. 21). When this ribbon was annealed at about 850° K. for about 15 minutes the maximum magnetic coercivity increased to about 10.5 kOe and the alloy exhibited hard magnetic characteristics.

When a like Nd-Fe-B alloy was melt spun and quenched in like manner on a chill disc having a surface velocity of $V_s=15$ meters per second, an amorphous to finely crystalline alloy was produced with an intrinsic room temperature coercivity of about 17 kOe (broken line in FIG. 21), much higher than that of the alloy quenched at $V_s=30$ either before or after annealing. When the alloy melt spun at $V_s=15$ meters per second was annealed at about 850° K., its intrinsic coercivity dropped to levels nearly matching those of the annealed $V_s=30$ samples. It is evident from this data that the melted and rapidly quenched alloys claimed herein are inherently different from their annealed counterparts.

As can be deduced from the data presented in the several figures, the invention relates to magnetically hard alloys having the general formula $RE_{1-x}(TM_{1-y}B_y)_x$ where RE is a suitable rare earth element as defined herein, TM is a transition metal, B is boron, x is the combined atomic fraction of transition metal and B elements where preferably $0.5 \lesssim x \lesssim 0.9$, and y is the atomic fraction of boron based on the amount of transition metal present and $0.01 \lesssim y \lesssim 0.10$, and substantially amorphous microstructure.

In summary, I have discovered that adding small amounts of boron to rapidly quenched, substantially amorphous or finely crystalline, RE-TM alloys significantly improves their hard magnetic properties (including coercivity, remanence and energy product) and increases their Curie temperatures. Having made this discovery, I examined the effect of several other metalloid elements on melt-spun RE-TM compositions expecting like results. Surprisingly, none of the others, including the elements auminum, germanium, carbon, silicon, and phosphorous, when incorporated in like compositions in like amounts and manner, provided any significant improvement in magnetic properties.

While my invention has been described in terms of specific embodiments thereof, clearly other forms may be readily adapted by one skilled in the art. Accordingly, the scope of my invention is to be limited only by the following claims.

The embodiments of the invention in which an exclusive property or privilege is claimed are defined as follows:

1. A magnetically hard alloy composition comprised of at least about 10 to about 40 atomic percent neodymium, praseodymium or mixtures thereof; at least about 50 to about 90 atomic percent iron and from about 0.5 to 10 atomic percent boron.

2. A magnetically hard alloy formed by melting and rapidly solidifying a mixture comprising from about 10 to about 40 atomic percent of one or more rare earth elements taken from the group consisting of praseodymium, neodymium, samarium, terbium, dysprosium, holmium, erbium, thulium, ytterbium, and mischmetals thereof where the neodymium and/or praseodymium comprise at least about 10 atomic percent of the total composition; up to about 90 atomic percent of one or more transition metals taken from the group consisting of iron, nickel and cobalt including at least about 50 atomic percent iron based on the total composition; and from about 0.5 to 10 atomic percent boron.

3. A magntically hard alloy composition formed by melting a mixture consisting essentially of at least about 10 to about 40 atomic percent neodymium, praseodymium, or mixtures thereof; at least about 50 to about 90 precent iron and greater than about 0.5 but less than about 10 atomic percent boron and quenching said mixture from its molten state at a rate such that the resultant alloy has a finely crystalline magnetic phase and intrinsic magnetic coercivity of at least about 1,000 Oersteds.

4. A magnetically hard alloy composition comprising one or more rare earth elements including at least about 10 to about 40 atomic percent of one or more rare earth elements taken from the group consisting of neodymium, praseodymium or mixtures thereof; at least about 50 to about 90 atomic percent iron, and at least about 0.5 atomic percent boron, said atomic percents being based on the total alloy composition and said alloy having an intrinsic magnetic coercivity of at least about 5,000 Oersteds at room temperature.

5. A magnetically hard alloy composition having a coercivity of at least about 1,000 Oersteds at room temperature and consisting essentially of one or more earth elements including at least about 10 to about 40 atomic percent neodymium and/or praseodymium based on the total composition; at least about 0.5 atomic percent boron; up to about 90 atomic percent of one or more transition metal elements taken from the group consisting of iron, nickel, and cobalt where said iron comprises at least about 50 atomic percent of the total alloy composition; the presence of the boron in the alloy increasing its Curie temperature with respect to a like alloy containing substantially no boron.

6. A magnetically hard, rapidly quenched alloy composition comprising at least about 10 to about 40 atomic percent of one or more rare earth elements taken from the group consisting of neodymium and praseodymium; from about 0.5 to about 10 atomic percent boron; and the balance one or more transition metal elements taken from the group consisting of iron, nickel and cobalt where said iron comprises at least about 50 atomic percent of the alloy composition.

7. A magnetically hard alloy having the constituent formula $$RE_{1-x}(TM_{1-y}B_y)_x$$

where RE is one or more earth elements taken from the group consisting of neodymium and praseodymium, TM is one or more transition metal elements taken from the group consisting of iron, nickel and cobalt; and B is the element boron; wherein said formula x is the combined atomic fraction of said transition metal and boron present in said composition and where x is about 0.5 to about 0.9 and wherein iron comprises at least about 50 atomic percent of the alloy; and wherein y is the atomic fraction boron based on the amount of transition metal and boron in said composition where y is about 0.01 to about 0.1; said magnetic alloy having a very finely crystalline microstructure, the presence of the boron in the alloy increasing its intrinsic magnetic coercivity with respect to a like alloy containing substantially no boron.

8. A hard magnet consisting essentially of an alloy having the constituent formula $$RE_{1-x}(F_{1-y}B_y)_x$$

where RE is one or more rare earth elements taken from the group consisting of praseodymium, neodymium or mixtures thereof; Fe is iron; and B is the element boron; wherein said formula x is the combined atomic fraction of said iron and boron present in said alloy where x is about 0.5 to about 0.9 and x times $(1-y)$ is greater than or equal to 0.5; and y is the atomic fraction boron based on the amount of iron and boron present in said alloy where y is about 0.01 to about 0.1.

9. A magnetically hard alloy composition having a coercivity of at least about 1,000 Oersteds at room temperature and comprising from about 10 to about 40 atomic percent of one or more rare earth elements taken from the group consisting of praseodymium, neodymium, samarium, terbium, dysprosium, holmium, erbium, thulium, ytterbium, and mischmetals thereof wherein the neodymium and/or praseodymium comprise at least about 10 atomic percent of the total composition; one or more transition metal elements including at least about 50 to 90 atomic percent iron based on the total composition; and at least about 0.5 atomic percent boron based on the total composition.

10. A magnetically hard alloy having a coercivity of at least about 1,000 Oersteds at room temperature formed by rapidly quenching a mixture comprised of about 10 to 40 atomic percent of one or more rare earth elements wherein at least about 10 atomic percent of said alloy is neodymium and/or praseodymium; greater than about 0.5 but less than about 10 atomic percent boron based on the total composition and up to about 90 percent of mixtures of iron and cobalt including at least about 50 atomic percent iron based on the total composition, the Curie temperature and energy product of said magnetically hard quenched alloy being higher than that of a like alloy processed in like manner which contains substantially no boron.

11. A magnetically hard alloy composition comprised of one or more rare earth elements including at least about 10 to about 40 atomic percent based on the alloy composition of neodymium and/or praseodymium; one or more transition metal elements including at least about 50 to 90 atomic percent iron based on the alloy composition, and greater than about 0.5 atomic percent of the alloy composition boron, said alloy having a magnetic coercivity of at least about 5,000 Oersteds and a remanence of at least about 4,000 Gauss at room temperature.

* * * * *